United States Patent [19]

Taylor et al.

[11] Patent Number: 4,640,752

[45] Date of Patent: Feb. 3, 1987

[54] METHOD FOR PRODUCING SILVER COLORED BRAZING ALLOY

[75] Inventors: Arthur D. Taylor, Foxboro; Thomas M. Upson, Norton, both of Mass.

[73] Assignee: Engelhard Corporation, Menlo Park, N.J.

[21] Appl. No.: 791,980

[22] Filed: Oct. 28, 1985

[51] Int. Cl.[4] ..... C25F 1/00

[52] U.S. Cl. ..... 204/141.5; 204/129.1

[58] Field of Search ..... 204/29, 32.1, 129.1, 204/129.75, 141.5

[56] References Cited

U.S. PATENT DOCUMENTS 2,504,906 4/1950 Tremblay ..... 204/32.1 X 2,661,330 12/1953 Sullivan ..... 204/141.5

3,372,468 3/1968 Pryor et al. ..... 29/527.2

3,528,896 9/1970 Davidoff et al. ..... 204/141.5

*Primary Examiner*—John F. Niebling

*Assistant Examiner*—William T. Leader

[57] ABSTRACT

A strip of silver-copper brazing alloy, connected to the positive terminal of a rectifier, is passed through an acid treatment bath containing a cathode adjacent each face of the strip. The strip is resistively heated to a temperature of at least 350° C. prior to its entry into the treatment bath by passing an electric current through the strip and the treatment bath to the cathodes. Copper oxide is electrolytically dissolved from the surface of the strip in the treatment bath.

1 Claim, 2 Drawing Figures

METHOD FOR PRODUCING SILVER COLORED BRAZING ALLOY

BACKGROUND OF THE INVENTION

Brazing alloys containing both silver and copper often exhibit a mottled copper color after casting, much to the dismay of purchasers who have paid a premium price for silver containing alloys and feel that the mottled copper color is both an indication of low silver content and improper manufacturing, even though these cosmetic blemishes are not reliable indicia of either quality or silver content. However, it is incumbent upon the manufacturer to respect his customers and provide products having the desired cosmetic appearance. The misleading copper color is usually caused by copper oxide at the casting surface. Mechanical means of removing the oxide are relatively inefficient or ineffective since the copper oxide is deeply imbedded into the metallic surface. Chemical methods such as those described in U.S. Pat. No. 3,372,468 are more effective in removing the undesired copper color but that technique is not suitable for large scale continuous production. The method and apparatus of this invention are well suited to continuous production of long rolls of silver copper alloy sheet material having a uniform silver or gray surface appearance at high speed. Further, the material produced by this invention may be rolled to about 70% of original thickness after treatment.

SUMMARY OF THE INVENTION

The process of the present invention comprises the steps of providing an acid treatment bath containing a cathode adjacent each face of the strip material, providing a supply roll of silver copper alloy sheet material spaced from said treatment bath, applying a positive voltage to said roll of sheet material, passing said sheet material to said treatment bath past said cathodes, the voltage, current residence time in the treatment bath, the distance between said sheet material and said cathode and the distance between said supply roll and said treatment bath being maintained at such values that the sheet material will reach a temperature of from at least about 350° to 780° C., preferably at least about 550° C., before entering the treatment bath, and the current density between the anode and cathode will be from about 15 to 35 Amps/sq. ft., and the copper oxide near the surface of the sheet material is dissolved. The apparatus of the present invention comprises:

supply means for providing a roll of silver copper alloy strip material;

a treatment bath containing an aqueous mineral acid spaced from the supply means;

a cathode disposed within the treatment bath;

means for passing the strip material through the treatment bath adjacent to but spaced from said cathode; and means for passing an electric current through said strip material and thereby resistively heating it to at least 350° C. prior to entry into said treatment bath and dissolving copper oxide in said strip material by passage of current from said strip material to said cathode.

DETAILED DESCRIPTION OF THE PREFERRED EMBODIMENTS

Figure 1:
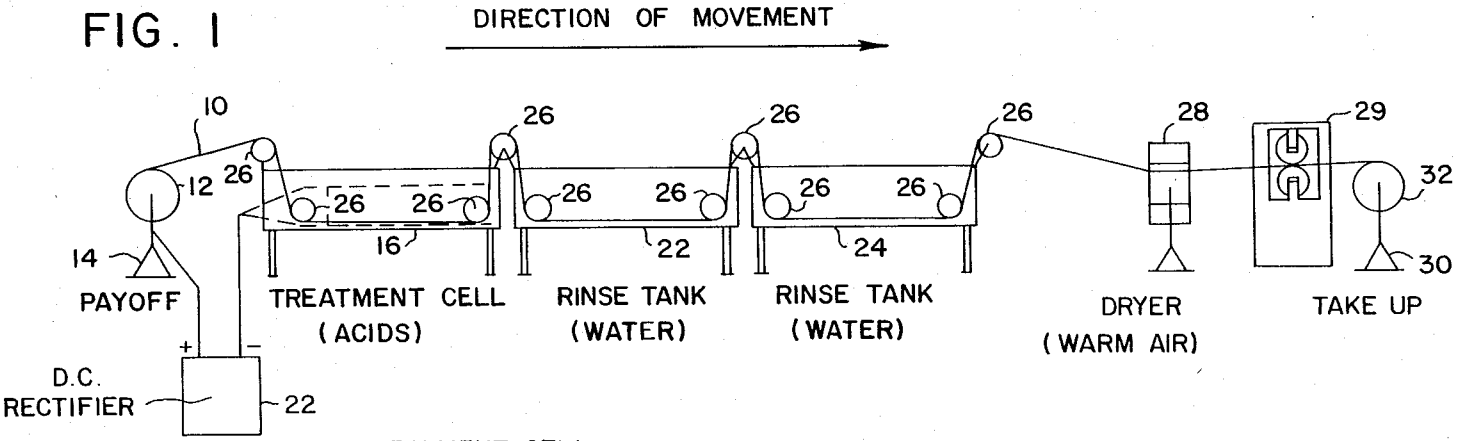
FIG. 1 is a schematic illustrating the apparatus and process of the present invention.
Figure 2:
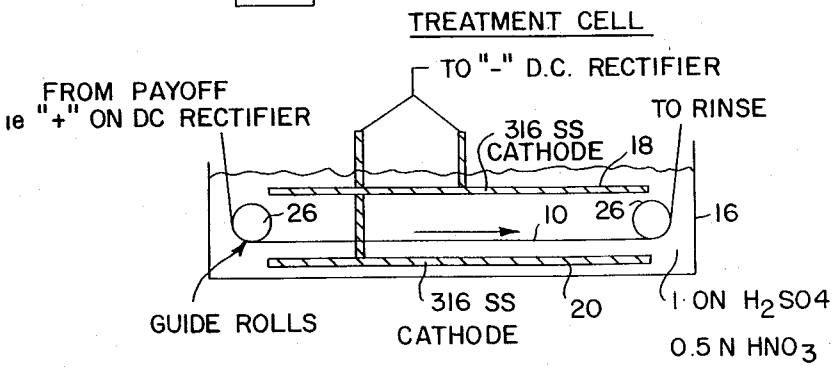
FIG. 2 is a schematic of the cell containing the treatment bath used in the present invention.

In FIG. 1, silver copper alloy strip material 10 is stored on supply roll 12 supported on supply reel 14 adjacent to, but spaced from, treatment cell 16 having stainless steel cathodes 18 and 20 disposed therein. The positive terminal of D.C. rectifier 22 is electrically connected to supply reel 14 while the negative terminal is connected to cathodes 18 and 20 disposed within treatment cell 16. Rinse tanks 22 and 24 are located adjacent treatment cell 16. Guide rolls 26 serve to confine strip material 10 to the desired path through treatment cell 16 and rinse tanks 22 and 24. Dryer 28 is located adjacent to rinse tank 24 and takeup reel 30 accumulates strip material 10 on takeup roll 32 after it passes through dryer 28 and finishing roller 29 which imparts a bright silvery finish to strip material 10.

In operation, silver copper alloy strip material 10 on supply roll 12 passes from supply reel 12 to treatment cell 16 while the electric current passing through strip material 10 resistively heats it to at least about 350° C. prior to its entry into treatment cell 16. Upon immersion in treatment cell 16, electric current passing from strip material 10 to cathodes 18 and 20 aids in dissolution of copper oxide from the surface of strip material 10 by acid contained within treatment cell 16. Upon exiting treatment cell 16, strip material 10 passes through rinse tanks 22 and 24 and leaves dryer 28 with a consistent silver gray surface. Upon passing through finish roller 29, the surface takes on a bright silvery aspect and may be stored on takeup roll 32 on takeup reel 30 for further fabrication.

The silver copper alloys used in the present invention consist essentially of from about 10% to about 70% silver, the balance being copper and optionally phosphorous. Upon heating to a temperature above 350° C., any silver oxide present decomposes to relatively insoluble metallic silver while copper near the surface is oxidized to relatively soluble copper oxide. Upon entering the treatment bath, the copper oxide is dissolved eventually depositing as copper on the cathodes.

The treatment bath may be a dilute solution of mineral acids such as sulfuric acid or nitric acid. The preferred acid is a mixture 1.0 N sulfuric and 0.5 N nitric acids. The preferred cathodes are stainless steel. Cathode current density and the rate at which material passes through the system are dependent upon the surface condition of the starting metal coil. As the quantity of surface oxides increases, so must be applied current for a fixed processing speed. Excessively high applied current leads to overheating of feed material (prior to treatment cell entry) resulting in an uneven surface color following system processing. Increasing processing rate (i.e., faster rewind rate at takeup reel) at a fixed current density proportionately reduces cathodic exposure to the stock in the treatment tank, thus reducing the average thickness of the silver rich layer formed. This reduction in the silver surface thickness may result in uneven surface color and/or eliminate the opportunity to continue rolling the alloy to thinner gauges since material elongation following uneven chemical processing usually produces pink or copper colored areas where the silver enriched surface was too thin. As a general rule, material treated appropriately can be reduced in thickness by about 20% to 30% before copper begins to show through the silver surface. For example, stock treated at 0.010" thick can be successfully rolled 0.007" and starting material at 0.004" reduced to 0.0029".

EXAMPLE I

A coil of AWS, B-CuP 5 (Cu 79–81, Ag 14–16, P 4.8–5.3) rolled to approximately 0.0032"×4" of arbitrary length is attached to a freewheeling metal payoff stand, threaded through a series of tank guide rolls and connected to the powered takeup reel (see general apparatus description attached). Both rinse tanks are filled with ambient deionized water while in the treatment cell, 316 stainless steel cathodes are installed below and above the stock material. The negative lead from a 250 A, 50 V, D.C. rectifier is attached jointly to both treatment cell cathodes with the positive lead attached to the base of the payoff stand. The electrolytic cell is then filled with an ambient solution which is 1.0 N $H_2SO_4$ and 0.5 N $HNO_3$. Current is applied so that the cathode current density is in the range of 20 to 30 Amps/$ft^2$ and the takeup reel is started and run at the rate of 3 to 10 ft/min.

After an initial startup period, during which the "leader" material clears the tank system, the copper colored alloy material leaving the payoff reel becomes hot (due to the high current density over the thin material) and the surface is lightly oxidized. Upon entering the treatment cell, the surface copper oxides dissolve in the acid solution with the assistance of the cathode current density. (Deposits of elemental copper gradually accumulate on the cathode surfaces.) The now silver colored material passes through the sequential ambient rinse tanks and through a warm air drying tunnel to be finally rewound on the takeup reel. (Typically, the material processed in this fashion would be rolled to a final thickness of about 0.0025". This final size reduction changes the surface from a moderately dull silver/gray to a highly reflective silver finish.)

EXAMPLE II

The procedure of Example I is repeated reversing the electrical connections to make the stainless steel plates in the treatment tank anodes rather than cathodes as suggested in U.S. Pat. No. 3,372,468. The process is ineffective in removing surface copper oxides even after a twofold increase of exposure time, current or acid concentration.

As our invention, we claim:

1. The process of imparting a uniform silver/gray surface appearance to silver copper alloy strip material comprising the steps of:

providing a supply roll of silver copper alloy strip material;

providing an acid treatment bath having a cathode disposed therein;

passing the strip material from the supply roll to the treatment bath; and resistively heating the strip material to at least 350° C. prior to its entry into the treatment bath by passing an electric current through the strip material and the treatment bath to the cathode; and electrolytically dissolving copper oxide from the surface of the strip material in the treatment bath.

* * * * *